US006955390B2

(12) United States Patent
Rigorth et al.

(10) Patent No.: US 6,955,390 B2
(45) Date of Patent: Oct. 18, 2005

(54) SERVO DRIVE FOR ACTIVATING A TAILGATE OF A MOTOR VEHICLE

(75) Inventors: Marcel Rigorth, Babenhausen (DE); Theo Baukholt, Kriftel (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 10/979,197

(22) Filed: Nov. 3, 2004

(65) Prior Publication Data

US 2005/0127711 A1 Jun. 16, 2005

(30) Foreign Application Priority Data

Nov. 5, 2003 (DE) ..... 103 52 167

(51) Int. Cl.[7] ..... B60J 5/10

(52) U.S. Cl. ..... 296/146.4; 296/56; 296/146.8; 49/342

(58) Field of Search ..... 296/146.4, 146.8, 296/50, 56, 57.1, 106; 49/334–338, 340, 49/341, 348, 349, 350, 342

(56) References Cited

U.S. PATENT DOCUMENTS 6,055,776 A * 5/2000 Dettling et al. ..... 49/341
6,135,536 A * 10/2000 Ciavaglia et al. ..... 296/146.4
6,270,147 B1 * 8/2001 Butler et al. ..... 296/146.4
6,382,706 B2 * 5/2002 Yuge et al. ..... 296/146.4
6,425,205 B2 * 7/2002 Wygle et al. ..... 49/349
6,676,190 B2 * 1/2004 Daniels et al. ..... 296/106
6,776,443 B2 * 8/2004 Shimura et al. ..... 296/56

FOREIGN PATENT DOCUMENTS

DE 10124783 A1 11/2002
EP 1072748 A2 1/2001
EP 1108846 A2 6/2001

OTHER PUBLICATIONS

Derwent-Abstract —DE-10124783A1; Nov. 28, 2002; Delphi Technologies, Inc. , Troy, Michigan, USA.

* cited by examiner

*Primary Examiner*—D. Glenn Dayoan
*Assistant Examiner*—Greg Blankenship
(74) *Attorney, Agent, or Firm*—Jacob Eisenberg; Siemens AG

(57) ABSTRACT

A servo drive for activating a tailgate of a motor vehicle has a drive, a sun wheel driven by the drive and rotatably mounted on a first axle, and a planetary wheel rotatably mounted on a second axle. The sun wheel engages with the planetary wheel. The first and second axles have ends, are movably arranged at their ends facing away from the drive in a common web, and are spaced apart from one another by a constant distance. The planetary wheel engages in a ring gear segment which is fixedly connected to a bodywork, and an end of the web, which faces the ring gear segment, is movably connected to a connecting rod through a third axle. An end of the connecting rod facing away from the third axle is movably connected, via a fourth axle, to an output element which is connected by an end facing away from the fourth axle to the tailgate.

6 Claims, 4 Drawing Sheets

SERVO DRIVE FOR ACTIVATING A TAILGATE OF A MOTOR VEHICLE

CROSS REFERENCE TO RELATED APPLICATIONS

The present application claims priority to German patent application number 10352167.4 filed on Nov. 5, 2003, which is herein incorporated by reference.

BACKGROUND OF THE INVENTION

The invention relates to a servo drive for activating a tailgate of a motor vehicle. Servo drives for activating tailgates of motor vehicles are known. For example, EP 1 108 846 A2 describes a pivoting door drive, which has a drive device. This drive device is of structurally complex design to such an extent that during operation a relatively large installation space is necessary, which is not available in many cases. In other known servo drives, pivotable ring gear segments are used which generally require, for operation, an installation space which, in the vicinity of the drive unit, must correspond in extent at least to the entire external diameter of the ring gear segment. However, this installation space is also often not available.

SUMMARY OF CERTAIN INVENTIVE ASPECTS

One aspect of the invention is therefore based on the object of providing a servo drive for activating a tailgate of a motor vehicle which requires only a relatively small amount of installation space for the driven parts in the vicinity of the drive.

In one embodiment, the object on which the invention is based is achieved by means of a servo drive for activating a tailgate of a motor vehicle having a drive, a sun wheel driven by the drive and rotatably mounted on a first axle, and a planetary wheel rotatably mounted on a second axle. The sun wheel is configured to engage with the planetary wheel. The first and second axles have ends, are movably arranged at their ends facing away from the drive in a common web, and are spaced apart from one another by a constant distance. The planetary wheel engages in a ring gear segment which is fixedly connected to a bodywork, and an end of the web, which faces the ring gear segment, is movably connected to a connecting rod by means of a third axle. An end of the connecting rod facing away from the third axle is movably connected, via a fourth axle, to an output element which is connected by an end facing away from the fourth axle to the tailgate.

The sun wheel and the planetary wheel are each embodied as gearwheels. They form a planetary gearwheel together with the common web and the ring gear segment. It is possible to fabricate the sun wheel and the first axle as an individual part, or to fit the sun wheel onto the first axle in a detachable fashion or attach it to it. In all three cases the first axle forms the axis of rotation for the sun wheel. In this arrangement, the web is fabricated in a flat fashion in the form of a piece of sheet metal (flat material). The connecting rod is also fabricated in a flat fashion in the form of a piece of sheet metal. Generally flat, curved pieces of sheet metal are used in the output element.

It has surprisingly been found that the servo drive for activating a tailgate of a motor vehicle only requires a relatively small amount of installation space. In the vicinity of the drive, this installation space is virtually defined by the circumference of the reference circle area which is bounded by the fixed ring gear segment. It is particularly advantageous that, in order to activate a tailgate of a motor vehicle, the servo drive can be arranged and operated virtually directly underneath the inside roof lining of the bodywork of the motor vehicle.

One embodiment of the invention involves the fact that the tailgate and the output element are composed of a single part. It is advantageous that connecting means such as screws or rivets or even additional connections such as welded connections between the output element and the tailgate can be dispensed with.

According to a further embodiment, the drive includes an electric motor. The servo drive can also be particularly advantageously operated by remote control in this way.

According to a further embodiment, a transmission means may be arranged between the drive and the sun wheel. A clutch which engages or disengages the drive and output can also be structurally provided in the transmission means. By arranging a transmission means it is possible to make the sun wheel smaller in diameter, which provides a further saving in installation space.

According to another embodiment, the worm of the electric motor engages in a first wheel of a first double gearwheel, and the second wheel of the first double gearwheel engages in a further first wheel of a second double gearwheel, the further first wheel forming the second double gearwheel together with the sun wheel. The transmission means can be made relatively compact in this way, which again provides a reduction in the installation space.

According to yet another embodiment, the ring gear segment is of semicircular design. That is, the ring gear segment covers an angle of virtually 180°. This is sufficient for most purposes of use so that further angular ranges advantageously do not need to be covered.

BRIEF DESCRIPTION OF THE SEVERAL VIEWS OF THE DRAWINGS

The invention is explained in more detail below by way of example with reference to the drawings (FIG. 1 to FIG. 7). In said drawings.

DETAILED DESCRIPTION OF CERTAIN INVENTIVE EMBODIMENTS

Figure 1:
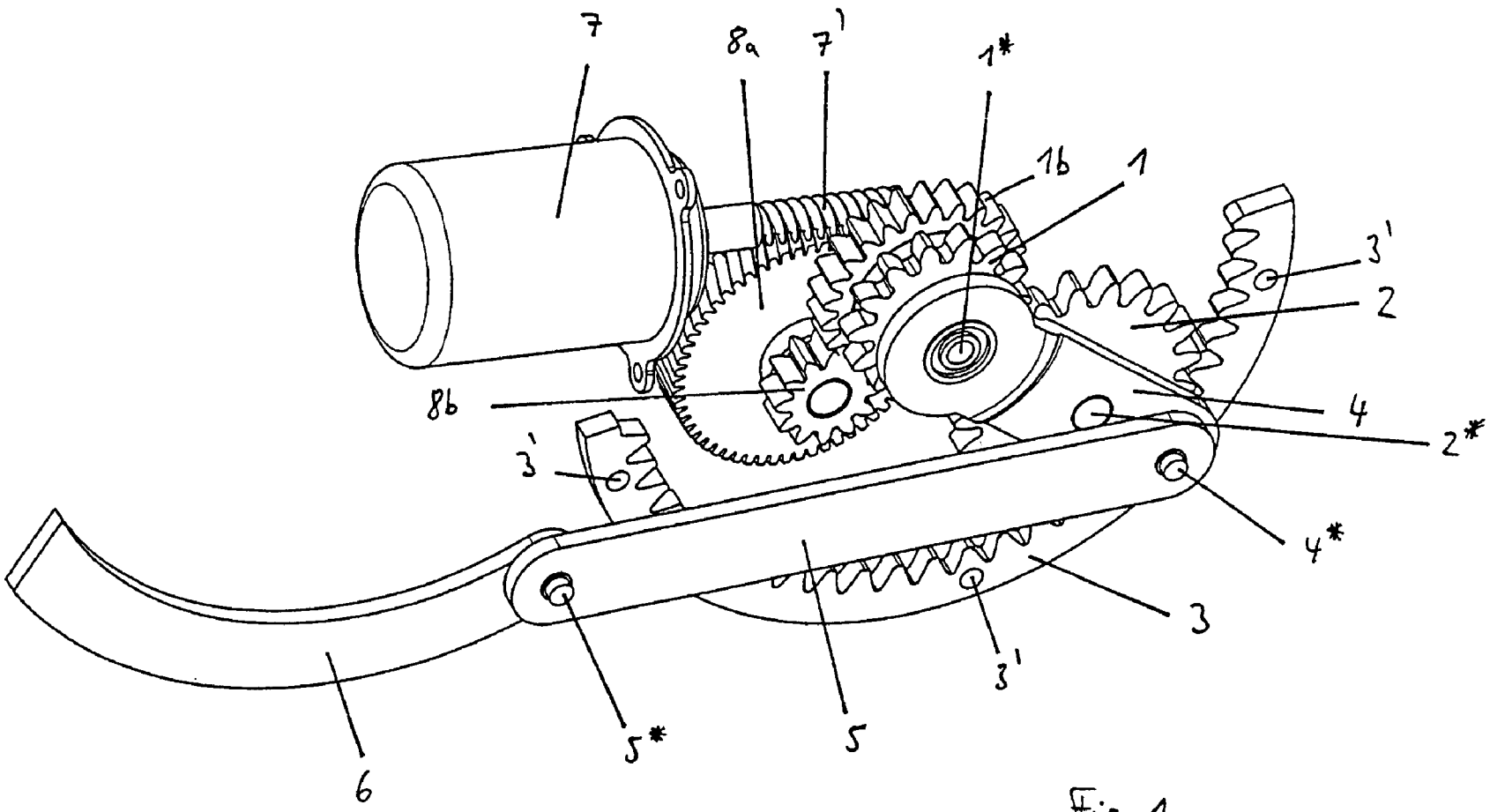
FIG. 1 shows the servo drive for activating the tailgate of a motor vehicle in a three-dimensional representation.

FIG. 1 illustrates the servo drive for activating the tailgate (not illustrated) of a motor vehicle in a three-dimensional fashion. In this servo drive, a sun wheel 1 which is driven by a drive 7 engages with a planetary wheel 2, the first axle 1*  about which the sun wheel 1 is rotatably mounted, and the second axle 2* on which the planetary wheel 2 is rotatably mounted, are movably arranged at their ends facing the drive 7 in a common web 4 and are spaced apart from one another by a constant distance. In one embodiment, the sun wheel 1 forms a unit with the first axle 1*. The planetary wheel 2 engages in a ring gear segment 3 which is fixedly connected to the bodywork (not illustrated) by means of the connecting elements 3'. That end of the web 4 which faces the ring gear segment 3 is movably connected via a third axle 4* to a connecting rod 5 whose end, facing away from the third axle 4*, is movably connected via a fourth axle 5* to the output element 6. The output element 6 is in turn connected at its end facing away from the fourth axle 5* to the tailgate (not illustrated).

An electric motor is arranged as the drive 7. The worm 7' of the electric motor engages in a first wheel 8*a* of a first double gearwheel 8*a*, 8*b*, and the second wheel 8*b* of the first double gearwheel 8*a*, 8*b* engages in a further first wheel 1*b* of a second double gearwheel 1*b*, 1. The first wheel 8*a* has in one embodiment a larger diameter than the second wheel 8*b*. The further first wheel 1*b* has a larger diameter than the sun wheel 1. The further first wheel 1*b* forms, together with the sun wheel 1, the second double gearwheel 1*b*, 1. The ring gear segment 3 is of semicircular design. The sun wheel 1, the planetary wheel 2, the web 4 and the ring gear segment 3 together form a planetary gear mechanism.

Figure 2:
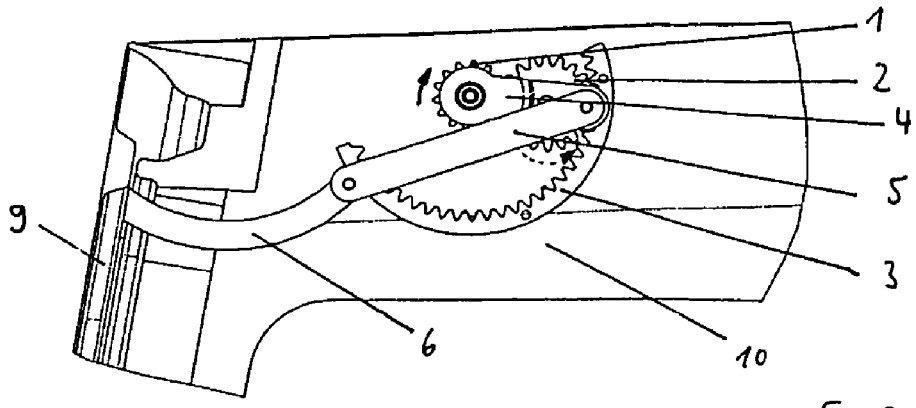
FIG. 2 shows the side view of the servo drive with a closed position of the tailgate.

FIG. 2 illustrates the side view of the servo drive with the tailgate 9 in a closed state. If the tailgate 9 is opened, the sun wheel 1 moves in the direction of the arrow via the drive (not shown). This results in the planetary wheel 2 rotating in the counterclockwise direction according to the arrow shown by a dashed line, and moving along the ring gear segment 3 which is fixedly connected to the bodywork 10.

Figure 3:
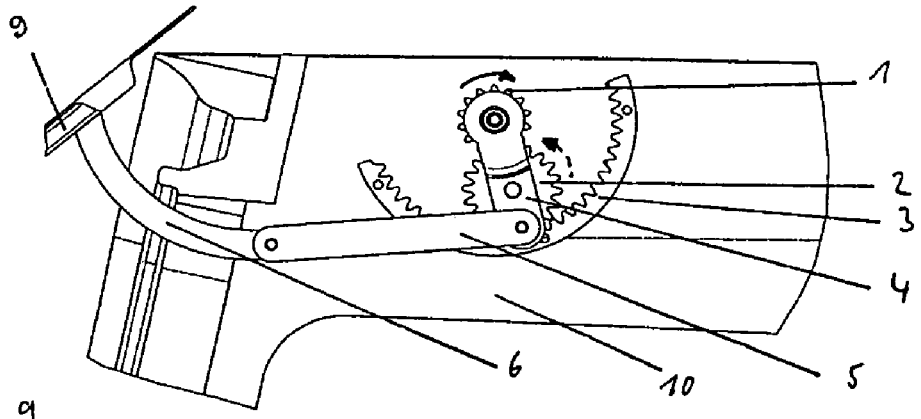
FIG. 3 shows the side view of the servo drive with a half-opened position of the tailgate.

FIG. 3 illustrates the side view of the servo drive with the tailgate 9 in a half-opened position. The ring gear segment 3 which is fixedly connected to the bodywork 10 remains unchanged in its position starting from the position illustrated in FIG. 2. The connecting rod 5 presses on the output element 6, which leads to a change in the position of the tailgate 9.

Figure 4:
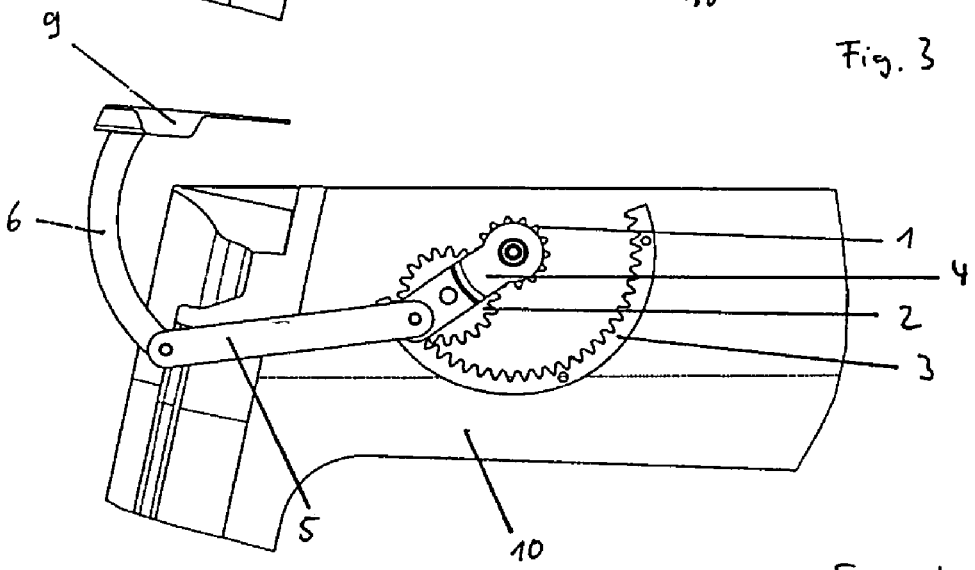
FIG. 4 shows the side view of the servo drive with a completely opened tailgate.

FIG. 4 illustrates the side view of the servo drive with the tailgate 9 in a completely opened position. The planetary wheel 2 has then almost completely passed through the ring gear segment 3, which can advantageously be carried out in a way which requires only a small amount of installation space.

Figure 5:
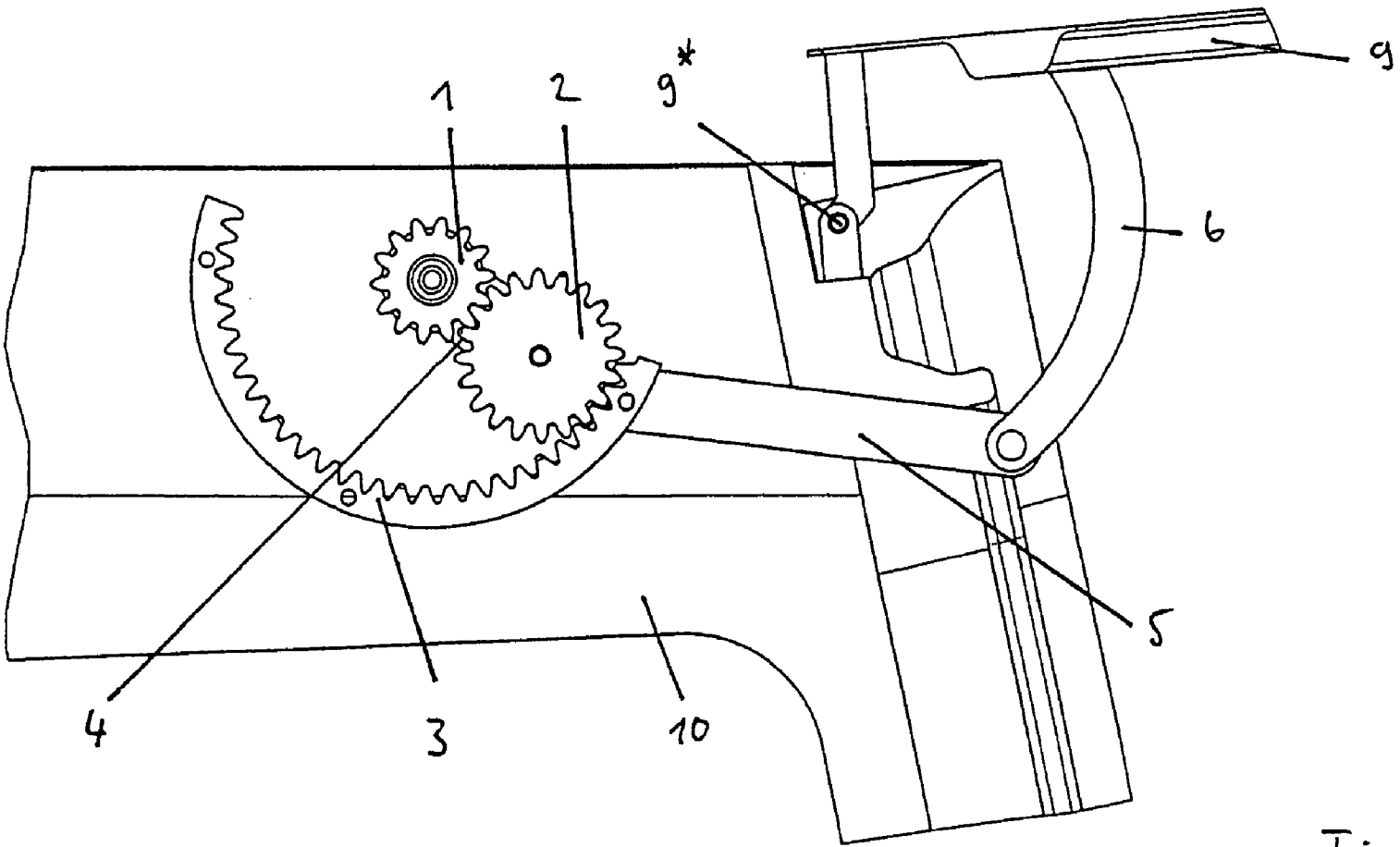
FIG. 5 shows the rear view of the servo drive with a completely opened tailgate according to FIG. 4.

FIG. 5 illustrates the rear view of the servo drive with the tailgate 9 in a completely opened position, according to FIG. 4. The sun wheel 1 engages directly with the planetary wheel 2. During the opening process, both the output element 6 and the tailgate 9 are pivoted about a common axis of rotation 9*.

Figure 6:
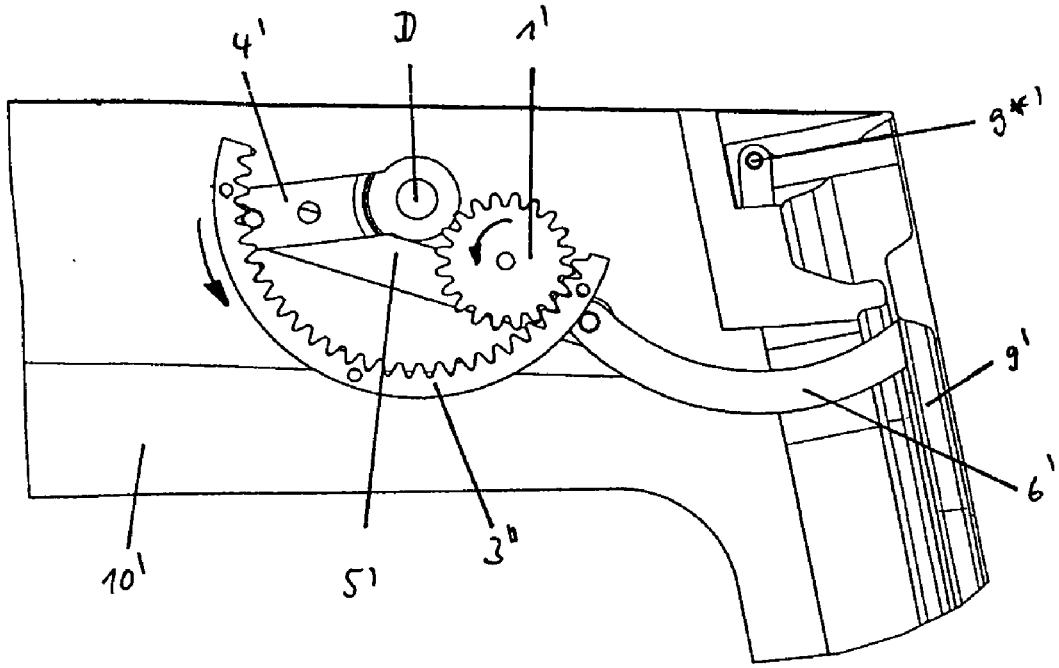
FIG. 6 shows the side view of a servo drive with the tailgate according to the prior art in the closed position.

FIG. 6 illustrates the side view of a servo drive according to the prior art with the further tailgate 9' in a closed position. There is no provision here to arrange components which together form a planetary gear mechanism. Such a known servo drive is composed of a drive wheel 1' which is rotated in the direction of the arrow in order to open the further tailgate 9'. The drive wheel 1' engages in a further ring gear segment 3", which is however not fixedly connected to the rest of the bodywork 10', but rather is movably mounted. The further ring gear segment 3" is connected on one side to a lever element 4' which is rotatably mounted by means of a further axis D of rotation. A further connecting rod 5' which is connected to the rest of the tailgate 9' via a further output element 6' is arranged on this lever element 4'. The further common axis 9*' of rotation forms the common axis of rotation for the output element 6' and the tailgate 9'. As soon as the drive wheel 1' is made to rotate in the direction of the arrow, the further ring gear segment 3" is also rotated in the direction of the arrow.

Figure 7:
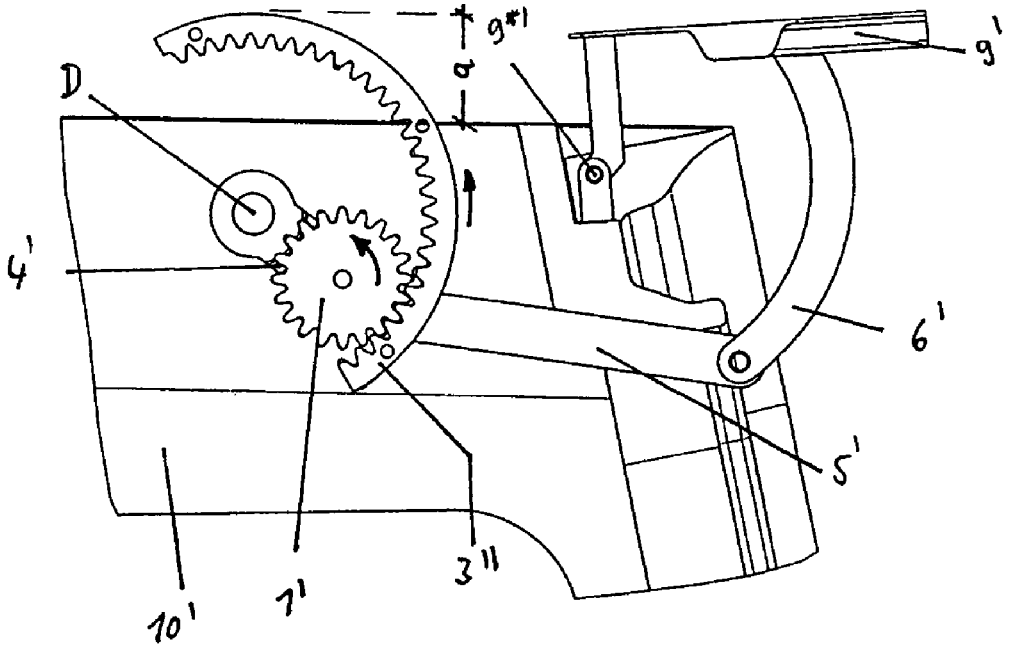
FIG. 7 shows the side view of a servo drive with a tailgate according to the prior art in the completely opened position.

FIG. 7 illustrates the side view of the servo drive with the further tailgate 9' according to the prior art in a completely opened position. The further ring gear segment 3" was pivoted starting from the position illustrated in FIG. 6. As is clearly apparent from FIG. 7, an arrangement of such a known servo drive for activating a tailgate 9' of a motor vehicle cannot be arranged directly underneath the inside roof lining of the bodywork since the additionally required installation space which corresponds in height to the distance a is not available. This fact makes it necessary to arrange the servo drive lower, which is structurally disadvantageous and also requires a larger installation space in the lower region, which space is not available in most cases.

We claim:

1. A servo drive for activating a tailgate of a motor vehicle, comprising:

a drive;

a sun wheel driven by the drive and rotatably mounted on a first axle; and a planetary wheel rotatably mounted on a second axle, the sun wheel configured to engage with the planetary wheel, wherein the first and second axles have ends, are movably arranged at their ends facing away from the drive in a common web, and are spaced apart from one another by a constant distance, wherein the planetary wheel engages in a ring gear segment which is fixedly connected to a bodywork, and an end of the web, which faces the ring gear segment, is movably connected to a connecting rod by means of a third axle, and wherein an end of the connecting rod facing away from the third axle is movably connected, via a fourth axle, to an output element which is connected by an end facing away from the fourth axle to the tailgate.

2. The servo drive of claim 1, wherein the tailgate and the output element are composed of a single part.

3. The servo drive of claim 1, wherein the drive includes an electric motor.

4. The servo drive of claim 1, wherein a transmission means is arranged between the drive and the sun wheel.

5. The servo drive of claim 3, wherein a worm of the electric motor engages in a first wheel of a first double gearwheel, and a second wheel of the first double gearwheel engages in a first wheel of a second double gearwheel, the first wheel of the second double gearwheel forming the second double gearwheel together with the sun wheel.

6. The servo drive of claim 1, wherein the ring gear segment is of semicircular design.

* * * * *